United States Patent [19]

Skogward

[11] Patent Number: 4,512,273

[45] Date of Patent: Apr. 23, 1985

[54] FEEDING MECHANISM IN A SEWING MACHINE

[75] Inventor: Kenneth O. E. Skogward, Huskvarna, Sweden

[73] Assignee: Husqvarna Aktiebolag, Huskvarna, Sweden

[21] Appl. No.: 514,819

[22] PCT Filed: Nov. 8, 1982

[86] PCT No.: PCT/SE82/00374

§ 371 Date: Jun. 24, 1983

§ 102(e) Date: Jun. 24, 1983

[87] PCT Pub. No.: WO83/01795

PCT Pub. Date: May 26, 1983

[30] Foreign Application Priority Data

Nov. 11, 1981 [SE] Sweden ..... 8106701

[51] Int. Cl.[3] ..... D05B 27/22; D05B 27/24

[52] U.S. Cl. ..... 112/315; 112/323

[58] Field of Search ..... 112/315, 314, 319, 323

[56] References Cited

U.S. PATENT DOCUMENTS 3,019,749 2/1962 Knobloch ..... 112/315

4,365,569 12/1982 Adams ..... 112/315

FOREIGN PATENT DOCUMENTS 880090 6/1953 Fed. Rep. of Germany ..... 112/223

*Primary Examiner*—H. Hampton Hunter

*Attorney, Agent, or Firm*—Alfred E. Miller

[57] ABSTRACT

A feeding module in the base on an electronic mechanical sewing machine is driven by an input shaft having two cam surfaces, one of which is arranged to drive a guide element in an oscillating movement. A block journalled on a shaft secured to a slide is displaceable in the guide by a mechanical or computer controlled electrical setting device. The slide is journalled in the feeder and displaceable perpendicularly to the working surface of the feeder. Upon a displacement of the slide the block will move into a corresponding position in the guide thereby effecting an adjustment of the feeding. The other cam surface is arranged to act upon a link connected to the transferring device to the feeder and is coordinated with the cam surfaces to guide the feeder in rectangular movements.

10 Claims, 5 Drawing Figures

FEEDING MECHANISM IN A SEWING MACHINE

This invention is related to sewing machines, more particularly to the feeding mechanism in the base of the sewing machine.

Problems caused by large size and large numbers of elements having a number of points at which play occurs are usual in the feeding mechanisms of most sewing machines. Large distances for transferring actions and elastically in links, and the like, lead to inaccuracy which is impossible to adjust. With regard to the assembly, it is unsatisfactory that a plurality of details must be inserted and adjusted directly in the body of the machine. An alternative to this is the assembly of the whole mechanism into a feeding module outside the machine and putting it into place without any time-consuming adjustments. When something is wrong with such a module it can easily be taken out of the machine to be mended or changed.

By the present invention it is presented a compact loop-taker and feeding module which essentially reduces the problems occurring in feeding mechanisms as above discussed. The small number of elements of the module and its smallness make a reduction of the number of points of play as well as of the elasticity of the system. Due to the fact that the shuttle mechanism is also in the module two functions of the machine according to the invention are gathered in one module. This leads to still another simplification of the work of adjustment in that the mutual time-setting of the hook and the feeder is carried out when assembling the module, after which the feeder and the hook follow in unison all time-settings of other instrumentalities in the machine. The problem of simplifying the assembling and adjustment of the hook and feeder mechanism is solved according to the invention in that the drive and adjustment means of the feeder are located in a frame which by means of fixing and adjusting points is applied to the base portion of the sewing machine.

Figure 1:
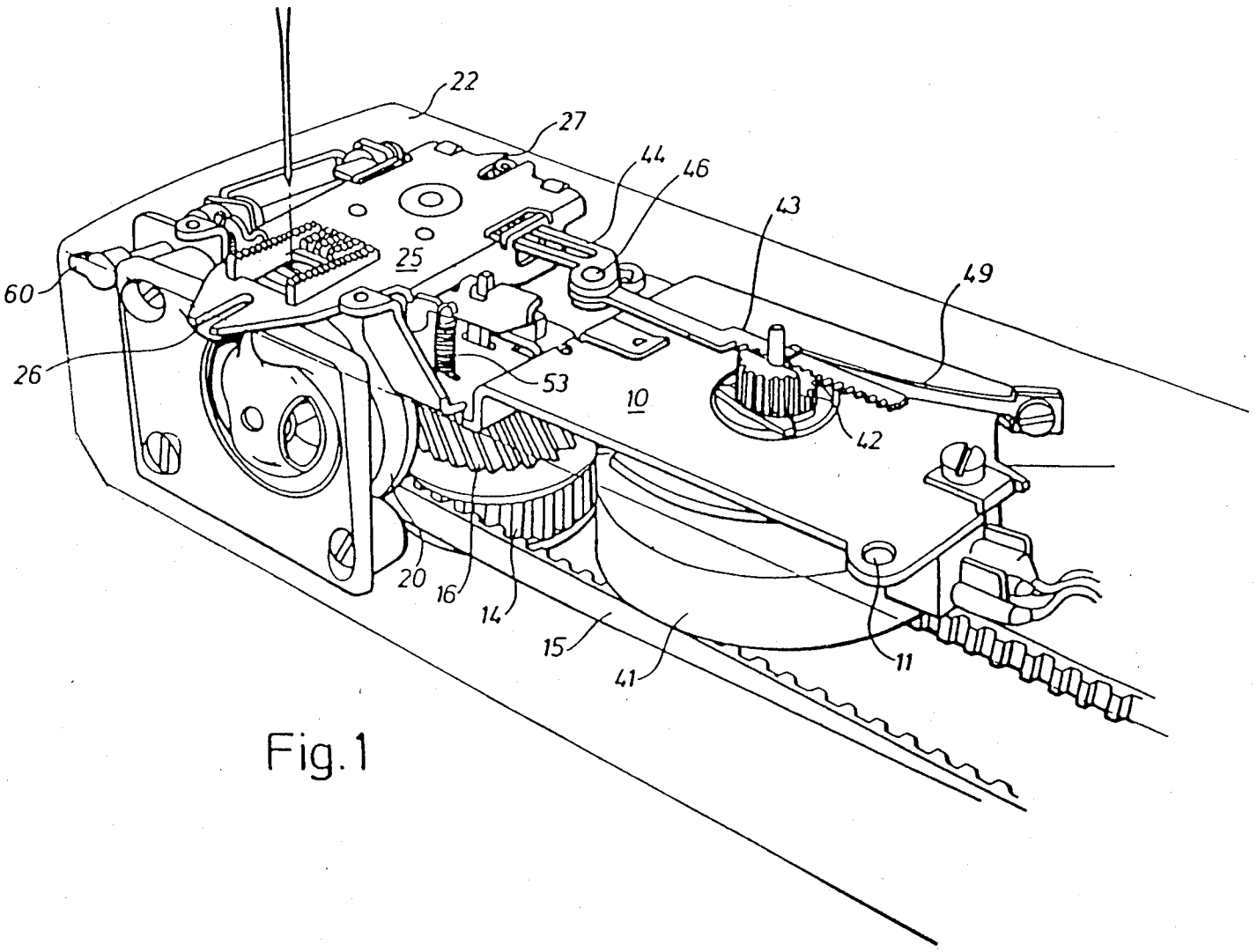
Figure 2:
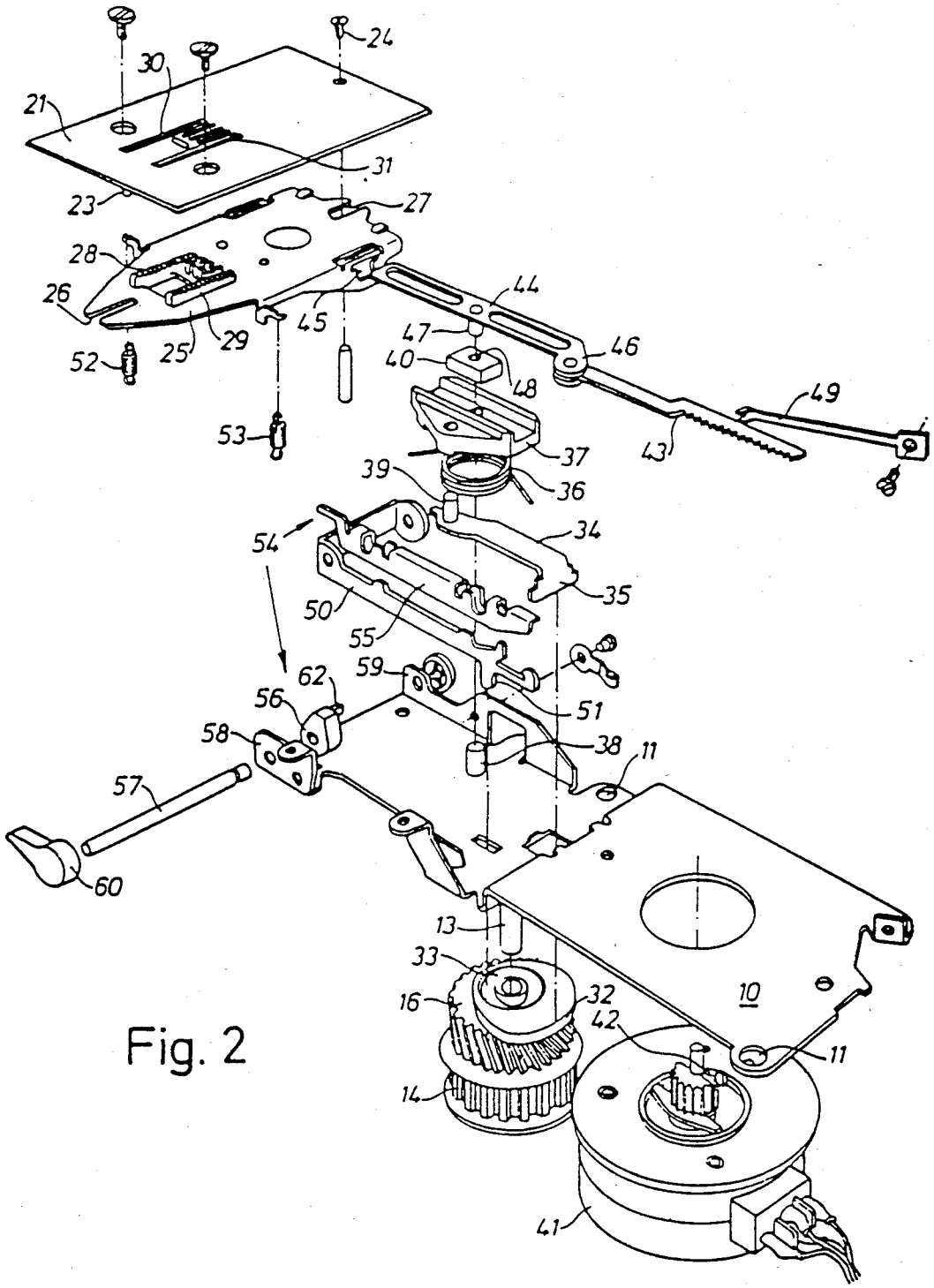
Figure 3:
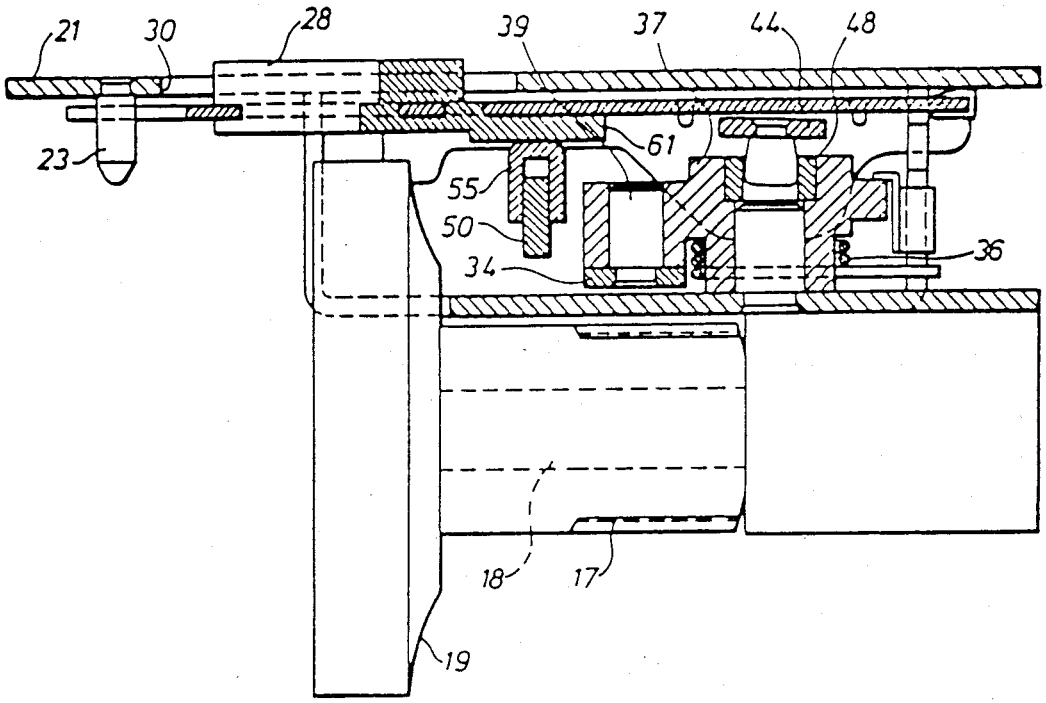
Figure 4A:
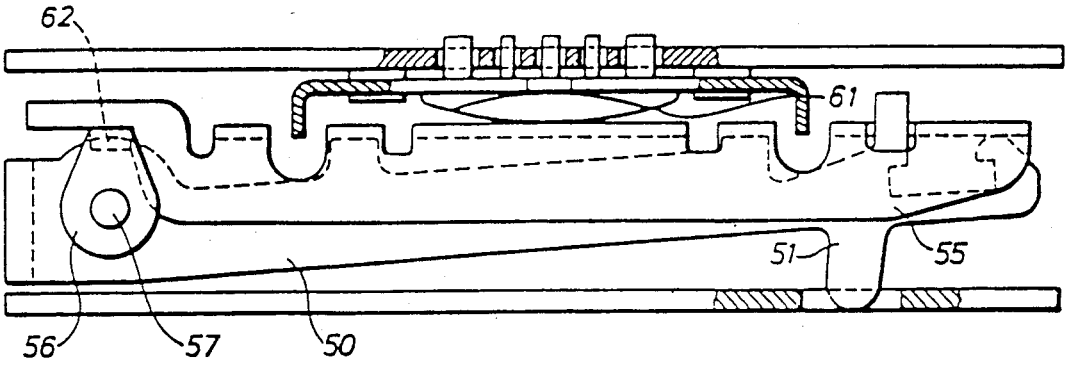
Figure 4B:
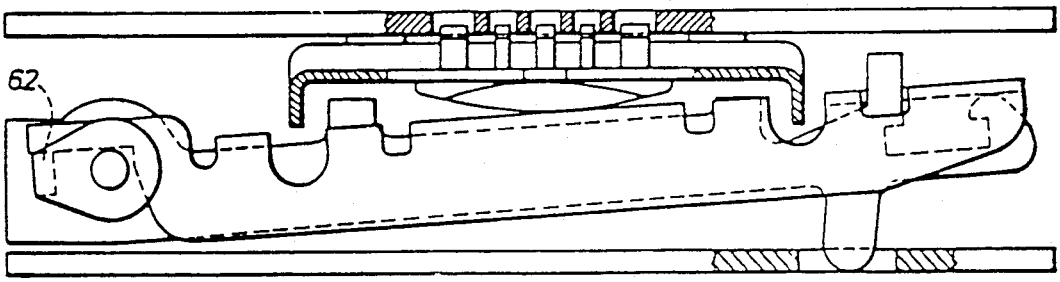

An embodiment of a mechanism according to the invention is described by way of example in the following with reference to the accompanying drawing in which in FIG. 1 is a view of a mechanism according to the invention in perspective, FIG. 2 is an exploded sketch of the mechanism, FIG. 3 is a vertical projection of the same and FIGS. 4*a* and 4*b* are cross sections of a level control member of a feeder showing a feeding position (a) and a lowered position (b).

The hook- and feeder mechanism module in accordance with the invention has a base plate 10 with screw holes 11 for screws (not shown) for holding the module in corresponding holes in the machine body (not shown) of the sewing machine. A vertical main shaft 13 is secured to the plate 10 (FIG. 2) and a toothed wheel 14, the wheel 14 being driven by a transmission belt 15 from the motor not shown of the machine. A mitre gear 16 journalled on the shaft and secured to the toothed wheel 14 meshes with a corresponding gear 17 (FIG. 3) on a horizontal hook shaft 18 which is also secured to the plate 10. The gears 16, 17 step up of the rotations so that the hook has double the r.p.m. as the toothed wheel 14. A hook carrier 19 journalled on the hook shaft drives the hook 20 (FIG. 1) in rotating movement in the vicinity of the lower end position of the needle. The top of the mechanism is covered by a stitch plate 21 (FIG. 2) sunk in the working surface (not shown) of the sewing machine and can be lifted away so that the mechanism becomes visible. On the underside of the stitch plate a couple of pins 23, 24 protrude, and a feeder 25 is journalled on pins 23, 24, by means of a couple slots 26, 27 extended in the material feeding direction. The feeder is plate shaped, having with a couple of stand-up rows of feeding teeth 28, 29 which protrude in a couple of slots 30, 31 in the stitch plate. Due to the guidance of elements 23, 26 and 24, 27 the rows of teeth 28, 29 move freely in the slots 30, 31 when they make a feeding movement.

The feeder 25 is controlled to have a rectangularly shaped feeding movement, in which the horizontal part of the movement is adjustable. The driving of the feeding movement is controlled by the gear 16 which on its top surface has a couple of cam surfaces 32, 33, the surface 32 being eccentric and the surface 33 having an axial curve. The eccentric surface 32 controls a slide 34 journalled in the plate 10 and displaceable in its longitudinal direction transverse to the direction of material movement. A cam follower 35 on the slide 34 is in contact with the eccentric surface 32 so that the slide 34 is forced away from the shaft 13 when the cam rotates. The slide is moved in the opposite direction by a spring 36 located at a swingable guide 37, the guide 37 being journalled on a shaft 38 on the plate 10 and joined to the slide by means of a pin 39 on the slide. The guide will then make an oscillating movement when the gear 16 rotates. A block 40 is journalled and displaceable in the guide 37 so that it can be driven thereby in the oscillating movement. The movement of the block 40 is determined by its position in the guide. Thus when the block 40 is in the middle of the guide 37 the center of the block will stand still (shown position). The displacement of the block in the guide is effected by an adjusting arrangement, in the shown embodiment driven by a stepping motor 41. This motor 41 has a pinion 42 driving a rack 43 in reciprocal movement in dependence on stepping pulses to the motor 41. Such stepping pulses are emitted by an electronic unit which is not here further described. The rack is extended to a slide 44 journalled in slots 45 in the feeder plate 25 and joined to the rack by a pivot 46. This slide 44 is located above the guide 37 and has a pin 47 protruding into a hole 48 in the block 40. Thus, the block can be displaced in the guide by means of the stepping motor 41 which also holds the block in an adjusted position. When the block 40 is adjusted to a position out of the center of the guide it is forced by the guide to make a reciprocal movement in the working direction of the feeder 25. The feeder plate is given this movement due to the fact that the slide 44 is journalled in the slots 45 of the feeder plate. The slide 44 can make this movement in the feeding direction due to the pivot 46 without disengagement of the rack from the pinion. A leaf spring 49 presses on the rack and holds it in mesh with the pinion.

The vertical movement of the feeder 25 is substantially constant in magnitude and coordinated with the horizontal movement so that the pattern of the movements forms approximately a rectangle. The feeder 25 is adequately long that only its fore end, where the rows of teeth are located, needs to make a vertical movement, to ensure that the rows of teeth arise above and sink below the working surface during of the sewing machine the several phases of the feeding. The rear end of the feeder 25 is pressed against the underside of the plate and slides against it during the feeding movements. The raising of the feeder 25 is brought about by the axial cam surface 33 which acts upon a lever arm 50 pivoted on the base plate 10 the arm 50 having a cam follower 51. When the cam surface 33 raises the arm 50, which it will do before the feeder 25 starts to make the horizontal movement, because of the coordination of the cam surfaces 32, 33, the arm raises the feeder 25 against the underside of the stitch plate 21. When the horizontal movement is complete the feeder is lowered by means of a couple of springs 52, 53 which always keep the feeder in contact with an externally operable manual level control member 54 in turn connected to the arm 50. This arrangement is illustrated in FIGS. 4*a* and *b* showing the arrangement in a cross section. The level control member is in this embodiment constituted of a bar 55 and an eccentric 56 on a shaft 57. Shaft 57 is journalled in a couple of bearing brackets 58, 59 manually turnable by means of a knob 60. In one of the positions of the eccentric 56 (FIG. 4*a*) the bar 55 is raised against a support 61 on the underside of the feeder 25, and a lug 62 on the eccentric 56 forms a fulcrum of the bar raised in its opposite end by the arm 50 which in its turn is actuated by the axial cam surface 33. A vertical movement is this transferred to the feeder plate 25. However, it can be disconnected so that the feeding does not take place for the reason that the rows of teeth 28, 29 are sunk below the stitch plate. This is brought about by turning the eccentric 56 to the other position (FIG. 4*b*) so that the lug 62 releases the bar 55 which then falls down to the arm 50 and thereby does not reach the support 61 during the movement of the arm. The springs 52, 53 will then always keep the feeder plate in its lower position whereby the feeding fails.

I claim:

1. In a feeding mechanism for a sewing machine, the sewing machine having a stitch plate and drive means, said feeding mechanism having a cloth feeder arranged below the stitch plate, first cam means moving the cloth feeder in a cloth feed direction and second cam means for moving the cloth feeder toward and away from said stitch plate, said first and second cam means being driven by said drive means; the improvement wherein said feeding mechanism further comprises a frame, a guide journalled on said frame about an axis substantially normal to said stitch plate, means coupled to said first cam means for reciprocably moving said guide, said first and second cam means being journalled to said frame, block means slidably mounted on said guide, slide means coupled to said block for moving said cloth feeder in said feed direction upon reciprocation of said guide, and adjustment means for moving said block means in a direction substantially perpendicular to said feed direction for adjusting the movement of said cloth feeder in said feed direction.

2. The feeding mechanism of claim 1 wherein said frame is mounted below said stitch plate, said first and second cam means being journalled on a shaft on said frame, and further comprising transmission means coupling said drive means of said sewing machine to rotate said first and second cam means.

3. The feeding mechanism of claim 2 wherein said transmission means comprises a transmission belt.

4. The feeding mechanism of claim 2 wherein said guide is journalled on a second shaft on said frame and parallel to said first-mentioned shaft.

5. The feeding mechanism of claim 1 wherein said means coupling said first cam means for reciprocably moving said guide comprises a connecting link.

6. The feeding mechanism of claim 1 wherein lever means are provided for moving said cloth feeder toward and away from said stitch plate by said second cam means.

7. The feeding mechanism of claim 1 wherein said cloth feeder comprises a plate mounted below said stitch plate and having rows of teeth extending therefrom toward said stitch plate.

8. The feeding mechanism of claim 7 wherein said plate forming said cloth feeder is mounted to be movable in said feed direction and one end thereof is pivoted about an axis parallel to said feed direction for permitting movement of said teeth toward and away from said stitch plate.

9. The feeding mechanism of claim 1 wherein spring means are provided for biasing said guide in one direction.

10. The feeding mechanism of claim 1 further comprising a shaft affixed to said frame and extending perpendicular to said stitch plate, a toothed wheel journalled on said shaft, a transmission belt coupling said drive means to said toothed wheel, said first and second cam means being mounted for rotation with sad toothed wheel, said feeding mechanism further comprising a hook, and gear means driven by said toothed wheel for rotating said hook.

* * * * *

UNITED STATES PATENT AND TRADEMARK OFFICE

CERTIFICATE OF CORRECTION

PATENT NO. : 4,512,273

DATED : April 23, 1985

INVENTOR(S) : KENNETH OSCAR EMANUEL SKOGWARD

It is certified that error appears in the above-identified patent and that said Letters Patent is hereby corrected as shown below:

In claim 10, line 43, delete "sad" and replace with --said--.

Signed and Sealed this

*Twenty-seventh* Day of *August 1985*

[SEAL]

*Attest:*

DONALD J. QUIGG

*Attesting Officer*

*Acting Commissioner of Patents and Trademarks*